US010409211B2

(12) United States Patent
Katsura

(10) Patent No.: US 10,409,211 B2
(45) Date of Patent: Sep. 10, 2019

(54) IMAGE FORMING APPARATUS

(71) Applicant: KYOCERA Document Solutions Inc., Osaka (JP)

(72) Inventor: Kenichi Katsura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/175,945

(22) Filed: Oct. 31, 2018

(65) Prior Publication Data

US 2019/0137922 A1 May 9, 2019

(30) Foreign Application Priority Data

Nov. 6, 2017 (JP) ..... 2017-213697

(51) Int. Cl.
*G03G 15/00* (2006.01)

(52) U.S. Cl.
CPC ..... *G03G 15/556* (2013.01); *G03G 15/502* (2013.01)

(58) Field of Classification Search
CPC ..... G03G 15/556; G02G 15/0863
See application file for complete search history.

(56) References Cited

U.S. PATENT DOCUMENTS 7,206,524 B2 4/2007 Yokoe
2005/0254833 A1 11/2005 Yokoe
2005/0254841 A1* 11/2005 Tomitaka ..... G03G 15/5079 399/12
2006/0140651 A1* 6/2006 Hirobe ..... G03G 15/0121 399/27
2007/0147854 A1* 6/2007 Yamada ..... G03G 15/553 399/12
2011/0299119 A1* 12/2011 Miyazaki ..... G03G 15/553 358/1.15
2016/0109825 A1* 4/2016 Webb ..... G03G 15/0856 399/61

FOREIGN PATENT DOCUMENTS

JP 2005-326732 A 11/2005

* cited by examiner

*Primary Examiner* — Sevan A Aydin
(74) *Attorney, Agent, or Firm* — Studebaker & Brackett PC

(57) ABSTRACT

An image forming apparatus includes a toner supply section, an image forming section, a touch panel, a determining section, a calculating section, and a display section. The determining section determines whether a toner container mounted to the toner supply section is a first container or a second container which differs from the first container. The calculating section calculates a consumption amount of toner consumed for the image forming section to form an image on paper when the determining section determines that the toner container is the second container. The display section displays a ratio of a second consumption amount to a first consumption amount on the touch panel. The first consumption amount is a consumption amount of the toner when the toner container is the first container. The second consumption amount is a consumption amount of the toner when the toner container is the second container.

9 Claims, 9 Drawing Sheets

IMAGE FORMING APPARATUS

INCORPORATION BY REFERENCE

The present application claims priority under 35 U.S.C. § 119 to Japanese Patent Application No. 2017-213697, filed on Nov. 6, 2017. The contents of this application are incorporated herein by reference in their entirety.

BACKGROUND

The present disclosure relates to an image forming apparatus.

An image forming apparatus stops displaying a remaining toner amount when an attached toner container is not genuine.

SUMMARY

An image forming apparatus according to an aspect of the present disclosure includes a mounting section, an image forming section, a display, a determining section, a calculating section, and a display section. A replacement component housing a consumable item is to be mounted to the mounting section. The image forming section forms an image on a recording medium by consuming the consumable item. The determining section determines whether the replacement component mounted to the mounting section is a first replacement component or a second replacement component which differs from the first replacement component. The calculating section calculates a consumption amount of the consumable item consumed for the image forming section to form the image on the recording medium when the determining section determines that the replacement component is the second replacement component. The display section displays a ratio of a second consumption amount to a first consumption amount or a ratio of the first consumption amount to the second consumption amount on the display. The first consumption amount is a consumption amount of the consumable item when the replacement component is the first replacement component. The second consumption amount is a consumption amount of the consumable item when the replacement component is the second replacement component.

DETAILED DESCRIPTION

Figure 1:
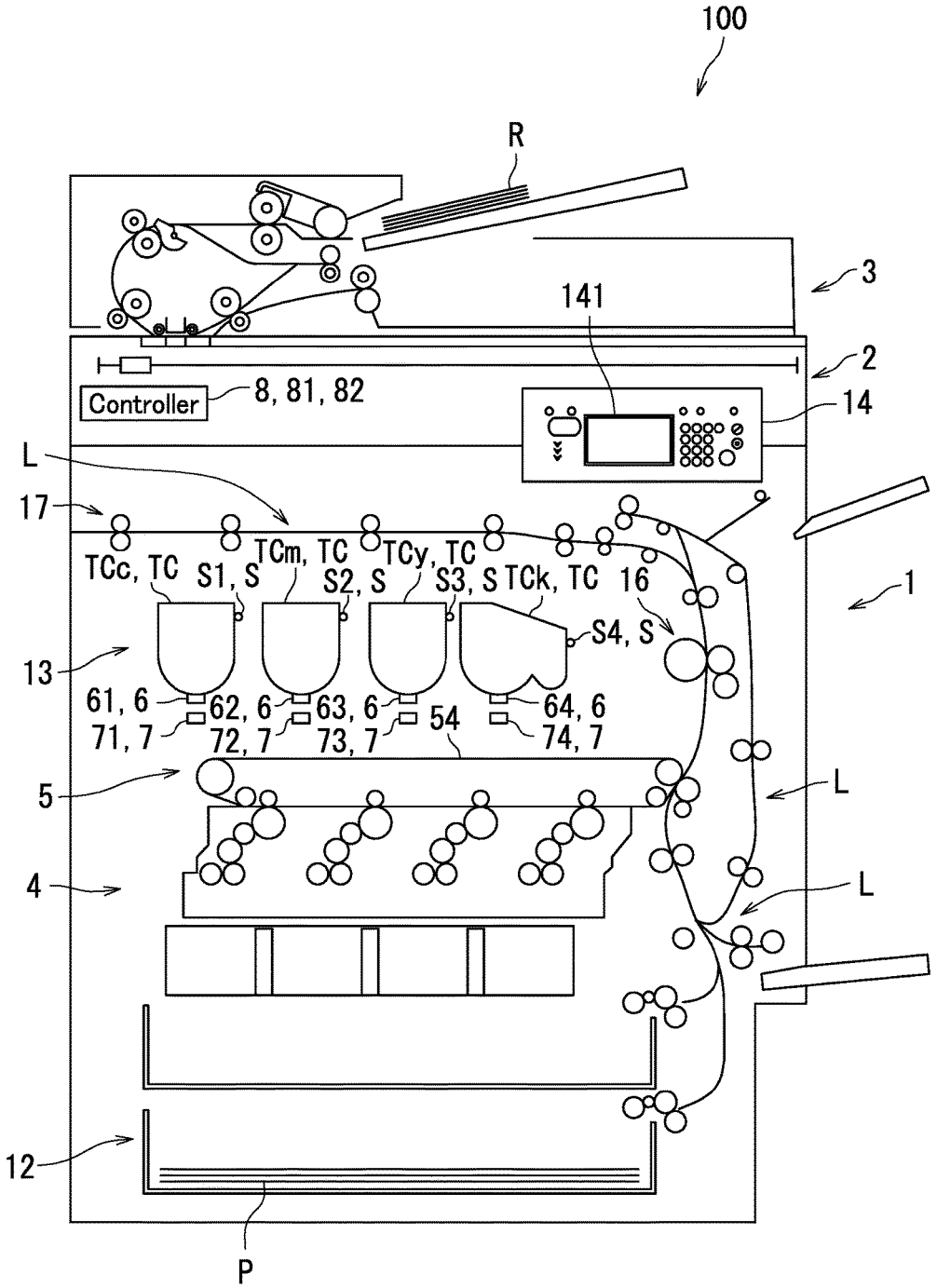
FIG. 1 is a diagram illustrating an example of a configuration of an image forming apparatus according to an embodiment of the present disclosure.

An embodiment of the present disclosure will be described as follows with reference to the accompanying drawings (FIGS. 1 to 9). Note that elements in the drawings that are the same or equivalent are labelled with the same reference signs and description thereof will not be repeated.

First, a configuration of an image forming apparatus 100 according to the embodiment of the present disclosure will be described with reference to FIG. 1. FIG. 1 is a diagram illustrating the configuration of the image forming apparatus 100. The image forming apparatus 100 is a color multifunction peripheral.

As illustrated in FIG. 1, the image forming apparatus 100 includes an image forming unit 1, an image reading unit 2, a document conveyance unit 3, an operation panel 14, and a controller 8. The image forming unit 1 forms an image on paper P. The image reading unit 2 reads an image formed on a document R and generates image information. The document conveyance unit 3 conveys the document R to the image reading unit 2. The operation panel 14 receives an operation from a user. The controller 8 controls operation of the image forming apparatus 100.

The image forming unit 1 includes a feeding section 12, a conveyance section L, a toner supply section 13, an image forming section 4, a fixing section 16, and an ejection section 17. The image forming section 4 includes a transfer section 5.

The feeding section 12 feeds the paper P to the conveyance section L. The conveyance section L conveys the paper P to the ejection section 17 by way of the transfer section 5 and the fixing section 16. The paper P is equivalent to an example of a "recording medium".

The toner supply section 13 supplies toner to the image forming section 4. A toner container TCc, a toner container TCm, a toner container TCy, and a toner container TCk are mounted to the toner supply section 13. The toner containers TCc to TCk are each equivalent to an example of a "replacement component". In the following description, the toner containers TCc to TCk may be generically referred to as a toner container TC. The toner supply section 13 is equivalent to an example of a "mounting section".

The toner container TCc houses a cyan toner TN1. The toner container TCc supplies the cyan toner TN1 to the image forming section 4. The toner container TCm houses a magenta toner TN2. The toner container TCm supplies the magenta toner TN2 to the image forming section 4. The toner container TCy houses a yellow toner TN3. The toner container TCy supplies the yellow toner TN3 to the image forming section 4. The toner container TCk houses a black toner TN4. The toner container TCk supplies the black toner TN4 to the image forming section 4. The cyan toner TN1, the magenta toner TN2, the yellow toner TN3, and the black toner TN4 are each equivalent to an example of a "consumable item". In the following description, the cyan toner TN1, the magenta toner TN2, the yellow toner TN3, and the black toner TN4 may be generically referred to as a toner TN.

The toner container TCc includes an integrated circuit (IC) tag 61. The IC tag 61 is located on a peripheral surface of the toner container TCc. The IC tag 61 stores identification information JDc for the toner container TCc. The toner container TCm includes an IC tag 62. The IC tag 62 is located on a peripheral surface of the toner container TCm. The IC tag 62 stores identification information JDm for the toner container TCm.

The toner container TCy includes an IC tag 63. The IC tag 63 is located on a peripheral surface of the toner container TCy. The IC tag 63 stores identification information JDy for the toner container TCy. The toner container TCk includes an IC tag 64. The IC tag 64 is located on a peripheral surface of the toner container TCk. The IC tag 64 stores identification information JDk for the toner container TCk. In the following description, the IC tags 61 to 64 may be generically referred to as an IC tag 6. Also, the identification information JDc, the identification information JDm, the identification information JDy, and the identification information JDk may be generically referred to as identification information JD.

The toner containers TCc to TCk are each freely attachable to and detachable from the toner supply section 13. The toner supply section 13 includes a remaining amount sensor S1, a reader 71, a remaining amount sensor S2, a reader 72, a remaining amount sensor S3, a reader 73, a remaining amount sensor S4, and a reader 74.

The remaining amount sensor S detects a remaining amount RTc of the cyan toner TN1 housed in the toner container TCc. The reader 71 reads the identification information JDc for the toner container TCc from the IC tag 61. The remaining amount sensor S2 detects a remaining amount RTm of the magenta toner TN2 housed in the toner container TCm. The reader 72 reads the identification information JDm for the toner container TCm from the IC tag 62.

The remaining amount sensor S3 detects a remaining amount RTy of the yellow toner TN3 housed in the toner container TCy. The reader 73 reads the identification information JDy for the toner container TCy from the IC tag 63. The remaining amount sensor S4 detects a remaining amount RTk of the black toner TN4 housed in the toner container TCk. The reader 74 reads the identification information JDk for the toner container TCk from the IC tag 64. In the following description, the remaining amount sensors S1 to S4 may be generically referred to as a remaining amount sensor S. Also, the readers 71 to 74 may be generically referred to as a reader 7. The remaining amount RTc, the remaining amount RTm, the remaining amount RTy, and the remaining amount RTk may be generically referred to as a remaining amount RT.

The image forming section 4 forms an image on the paper P. The transfer section 5 includes an intermediate transfer belt 54. The image forming section 4 transfers cyan, magenta, yellow, and black toner images onto the intermediate transfer belt 54. The toner images of the respective colors are superimposed on the intermediate transfer belt 54 to form an image on the intermediate transfer belt 54. The transfer section 5 transfers the image formed on the intermediate transfer belt 54 onto the paper P. As a result, the image is formed on the paper P. The image forming section 4 will be described later in detail with reference to FIG. 2.

The fixing section 16 applies heat and pressure to the paper P to fix the image formed on the paper P to the paper P. The ejection section 17 ejects the paper P out of the image forming apparatus 100.

The operation panel 14 includes a touch panel 141. The touch panel 141 includes a liquid-crystal display (LCD), for example, and displays various images. The touch panel 141 also includes a touch sensor, and receives operation from the user. The touch panel 141 is equivalent to an example of a "display".

The controller 8 includes a processor 81 and storage 82. The processor 81 includes a central processing unit (CPU), for example. The storage 82 includes memory such as semiconductor memory, and may include a hard disk drive (HDD). The storage 82 stores a control program.

Figure 2:
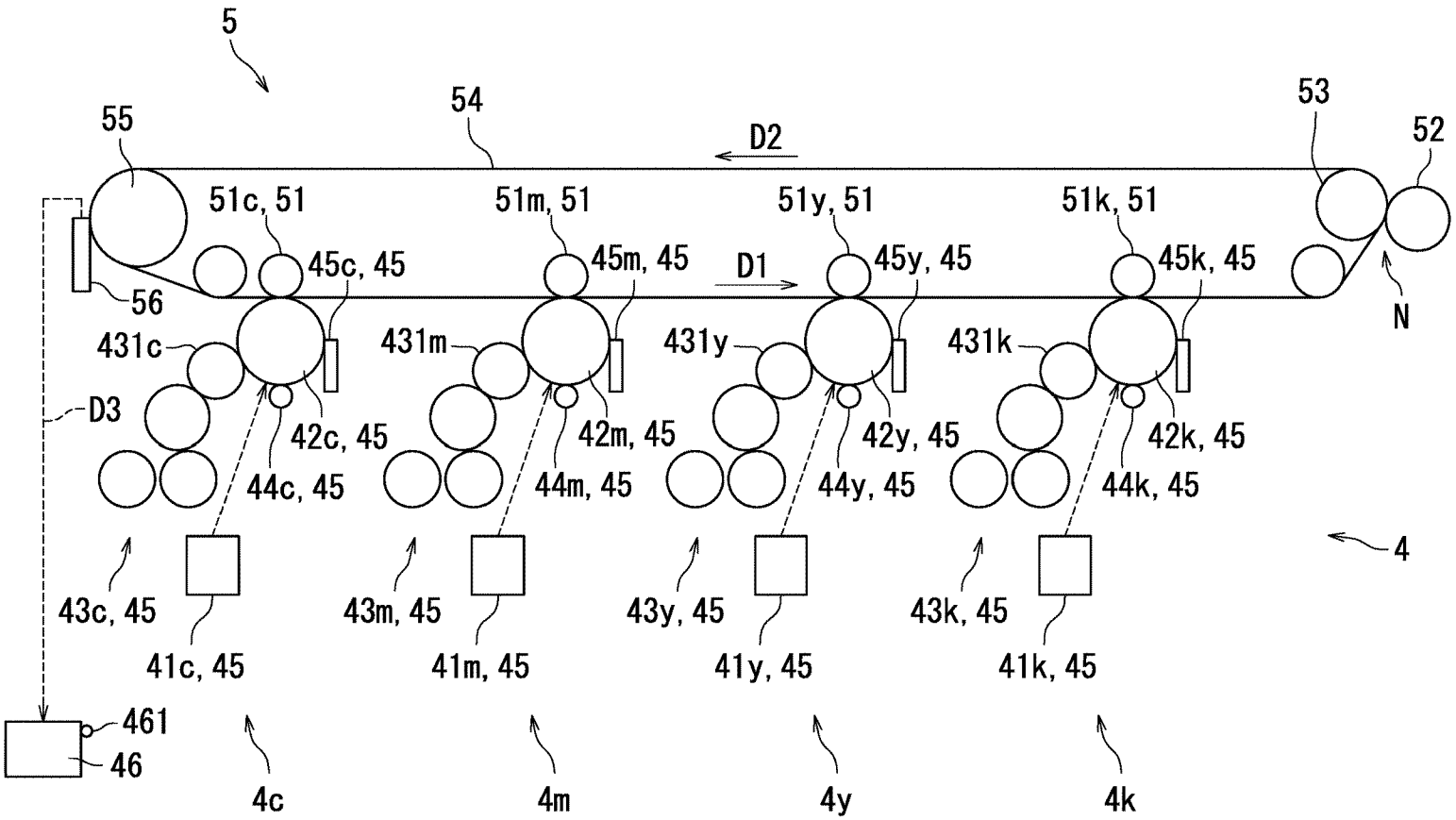
FIG. 2 is a diagram illustrating an example of a configuration of an image forming section according to the embodiment of the present disclosure.

Next, a configuration of the image forming section 4 according to the embodiment of the present disclosure will be described with reference to FIGS. 1 and 2. FIG. 2 is a diagram illustrating an example of the configuration of the image forming section 4. As illustrated in FIG. 2, the image forming section 4 includes an image forming section 4*c*, an image forming section 4*m*, an image forming section 4*y*, and an image forming section 4*k*.

The image forming section 4*c*, the image forming section 4*m*, the image forming section 4*y*, and the image forming section 4*k* each include an exposure section 41, a photosensitive drum 42, a development section 43, a charging roller 44, and a cleaning blade 45. Aside from being supplied toners of different colors, the image forming section 4*c*, the image forming section 4*m*, the image forming section 4*y*, and the image forming section 4*k* all share substantially the same configuration. Accordingly, the configuration of the image forming section 4*c* to which the cyan toner TN1 is supplied will be described in the following, and descriptions of the image forming section 4*m*, the image forming section 4*y*, and the image forming section 4*k* will be omitted.

The image forming section 4*c* includes an exposure section 41*c* (41), a photosensitive drum 42*c* (42), a development section 43*c* (43), a charging roller 44*c* (44), and a cleaning blade 45*c* (45).

The charging roller 44*c* charges the photosensitive drum 42*c* to a predetermined potential. The exposure section 41*c* emits laser light to expose the photosensitive drum 42*c*, thus forming an electrostatic latent image on the photosensitive drum 42*c*. The development section 43*c* includes a development roller 431*c*. The development roller 431*c* supplies the cyan toner TN1 to the photosensitive drum 42*c* to develop the electrostatic latent image into a toner image. As such, a cyan toner image is formed on a peripheral surface of the photosensitive drum 42*c*.

A distal end (upper end in FIG. 2) of the cleaning blade 45*c* slides on the peripheral surface of the photosensitive drum 42*c*. Residual cyan toner TN1 is removed from the peripheral surface of the photosensitive drum 42*c* by the distal end of the cleaning blade 45*c* sliding on the peripheral surface of the photosensitive drum 42*c*.

The transfer section 5 transfers the toner image to the paper P. The transfer section 5 includes primary transfer rollers 51, a secondary transfer roller 52, a drive roller 53, the intermediate transfer belt 54, and a driven roller 55. The primary transfer rollers 51 transfer cyan, magenta, yellow, and black toner images from the photosensitive drums 42 to the intermediate transfer belt 54. The primary transfer rollers 51 include a primary transfer roller 51*c*, a primary transfer roller 51*m*, a primary transfer roller 51*y*, and a primary transfer roller 51*k*.

The drive roller 53 drives the intermediate transfer belt 54. The intermediate transfer belt 54 is an endless belt which is stretched around the primary transfer rollers 51, the drive roller 53, and the driven roller 55. The intermediate transfer belt 54 is driven to rotate in a counterclockwise direction by the drive roller 53, as illustrated by arrows D1 and D2. The driven roller 55 is driven to rotate along with the rotation of the intermediate transfer belt 54. A blade 56 removes residual toner TN from an obverse surface of the intermediate transfer belt 54.

The image forming section 4 is configured such that a waste toner container 46 is mountable thereto. The waste toner container 46 houses waste toner TND. The waste toner TND includes the toner TN that has been removed by the cleaning blade 45 and the toner TN that has been removed by the blade 56.

The image forming section 4 further includes a waste toner amount sensor 461. The waste toner amount sensor 461 detects an amount of the waste toner TND housed in the waste toner container 46.

The secondary transfer roller 52 is pressed against the drive roller 53, thus forming a nip part N between the secondary transfer roller 52 and the drive roller 53. As the paper P passes through the nip part N, the secondary transfer roller 52 transfers the toner image on the intermediate transfer belt 54 to the paper P.

Figure 3:
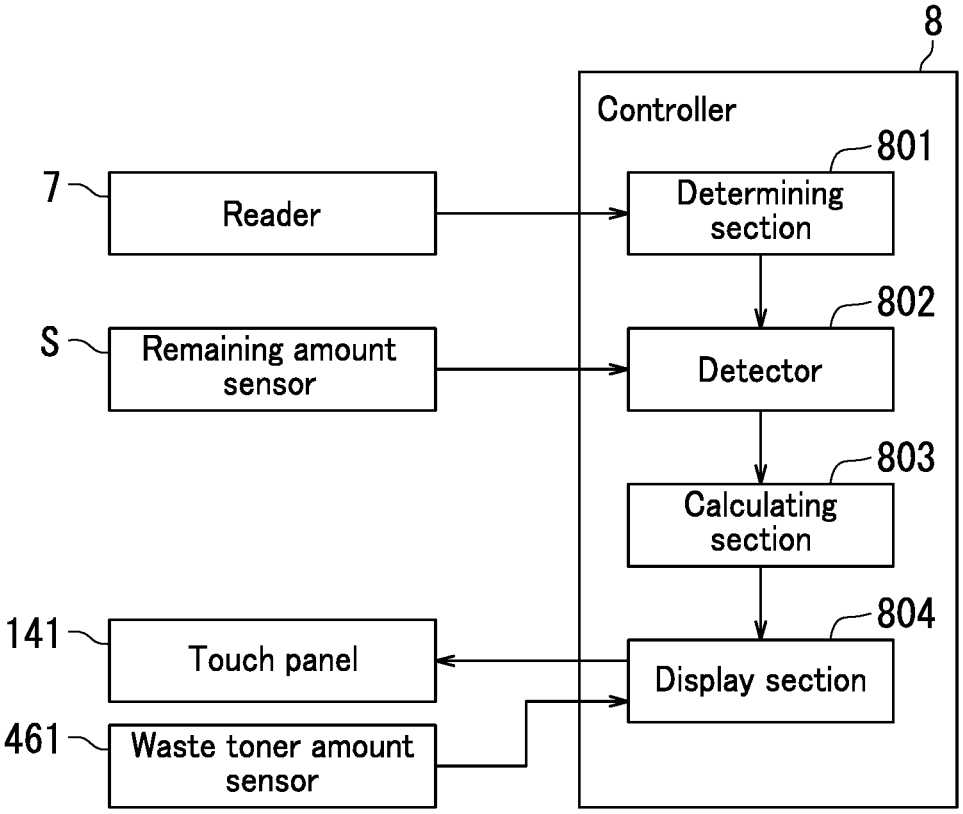
FIG. 3 is a diagram illustrating an example of a configuration of a controller according to the embodiment of the present disclosure.

Next, a configuration of the controller 8 according to the embodiment of the present disclosure will be described with reference to FIGS. 1 to 3. FIG. 3 is a diagram illustrating an example of the configuration of the controller 8.

As illustrated in FIG. 3, the controller 8 includes a determining section 801, a detector 802, a calculating section 803, and a display section 804. Specifically, the processor 81 of the controller 8 functions as the determining section 801, the detector 802, the calculating section 803, and the display section 804 by executing the control program.

The determining section 801 determines whether the toner container TC mounted to the toner supply section 13 is a first container TC1 or a second container TC2 which differs from the first container TC1. The first container TC1 is genuine, for example. The second container TC2 is not genuine, for example.

Specifically, the determining section 801 acquires the identification information JD of the toner container TC mounted to the toner supply section 13 through the reader 7. The determining section 801 then determines whether the toner container TC is a first container TC or a second container TC2 based on the identification information JD of the toner container TC.

The detector 802 detects the remaining amount RT of the toner TN housed in the toner container TC through the remaining amount sensor S.

When the determining section 801 determines that the toner container TC is a second container TC2, the calculating section 803 calculates a consumption amount QT of the toner TN consumed for the image forming section 4 to form the image on the paper P. Specifically, the calculating section 803 calculates the consumption amount QT of the toner TN consumed for the image forming section 4 to form the image on the paper P based on a detection result of the detector 802.

The display section 804 displays a ratio of a second consumption amount ST2 to a first consumption amount ST1 on the touch panel 141. The first consumption amount ST1 is the consumption amount QT of the toner TN when the toner container TC is a first container TC1. The second consumption amount ST2 is the consumption amount QT of the toner TN when the toner container TC is a second container TC2.

As described above with reference to FIGS. 1 to 3, the ratio of the second consumption amount ST2 to the first consumption amount ST1 is displayed on the touch panel 141 in the embodiment of the present disclosure. Therefore, the user can ascertain the ratio of the second consumption amount ST2 to the first consumption amount ST1. Accordingly, convenience to the user can increase.

Note that in the embodiment of the present disclosure, the display section 804 displays the ratio of the second consumption amount ST2 to the first consumption amount ST1, but the present disclosure is not limited as such. The display section 804 may also display a ratio of the first consumption amount ST1 to the second consumption amount ST2.

Also in the embodiment of the present disclosure, the display section 804 displays the ratio of the second consumption amount ST2 to the first consumption amount ST1, but the present disclosure is not limited as such. The display section 804 may also display a ratio of a second waste toner amount to a first waste toner amount. The first waste toner amount is an amount of waste toner TND occurring when the toner container TC is a first container TC1. The second waste toner amount is an amount of waste toner TND occurring when the toner container TC is a second container TC2. In this case, the user can ascertain the ratio of the second waste toner amount to the first waste toner amount. Accordingly, the convenience to the user can increase. Note that the second waste toner amount is detected by the waste toner amount sensor 461.

Figure 4:
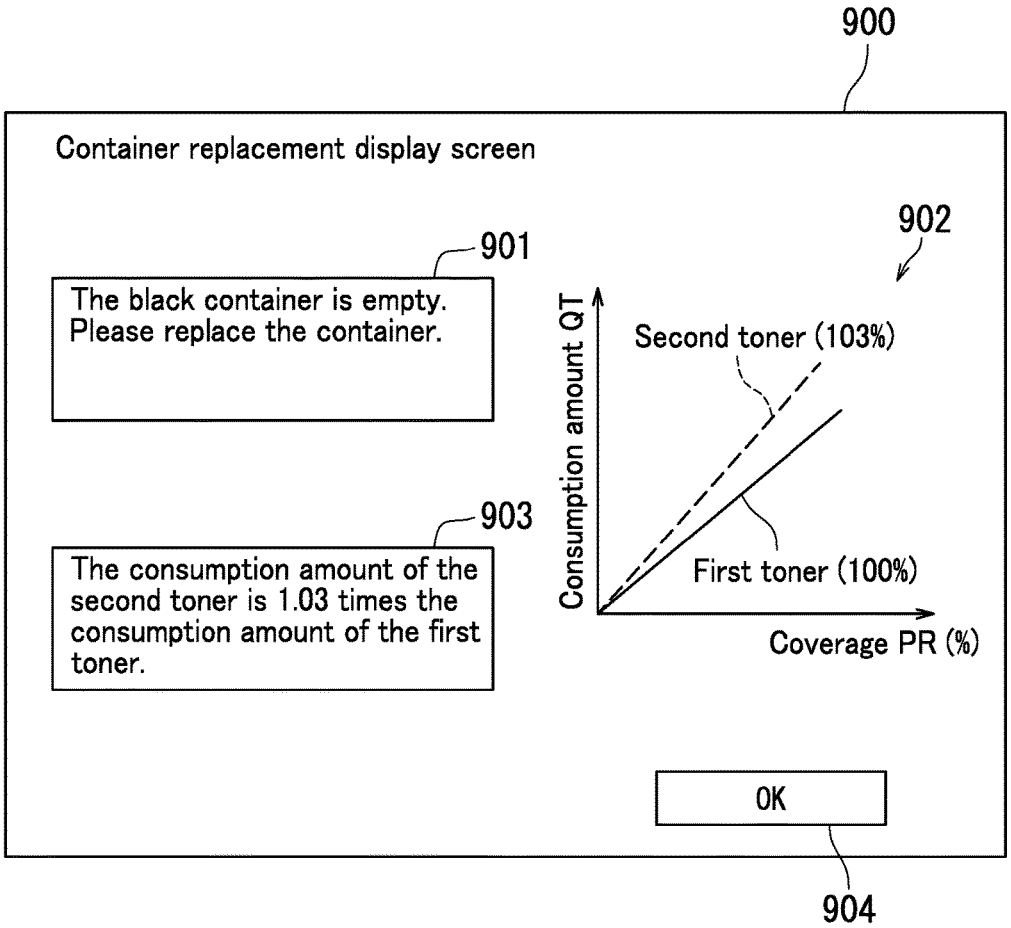
FIG. 4 is a screen diagram illustrating an example of a container replacement display screen displayed on a touch panel.

Next, the configuration of the controller 8 will be further described with reference to FIGS. 3 to 4. FIG. 4 is a screen diagram illustrating an example of a container replacement display screen 900 displayed on the touch panel 141. The container replacement display screen 900 is displayed by the display section 804 when the toner container TCk has become empty. A case in which the image formed on the paper P is monochrome is described using FIG. 4.

As illustrated in FIG. 4, a first message display area 901, a graph display area 902, a second message display area 903, and an OK button 904 are displayed in the container replacement display screen 900.

A message indicating that the toner container TCk has become empty is displayed in the first message display area 901. For example, the following message is displayed in the first message display area 901: "The black container is empty. Please replace the container."

The ratio of the second consumption amount ST2 to the first consumption amount ST1 is displayed as graphs in the graph display area 902. A horizontal axis of the graphs indicates a coverage PR and a vertical axis of the graphs indicates the consumption amount QT. A graph corresponding to the first consumption amount ST1 is indicated by a solid line and a graph corresponding to the second consumption amount ST2 is indicated by a dotted line. The first consumption amount ST1 is displayed as "first toner" and the second consumption amount ST2 is displayed as "second toner" in the graph display area 902. The ratio of the second consumption amount ST2 to the first consumption amount ST1 is 1.03, which is displayed as "first toner (100%)" and "second toner (103%)".

The coverage PR means a ratio of a cumulative surface area SR1 of the image formed on the paper P to a surface area SR2 of the paper P (SR1/SR2). Specifically, the cumulative surface area SR1 indicates a sum of cumulative surface areas of images formed on the paper P with the cyan toner TN1, the magenta toner TN2, the yellow toner TN3, and the black toner TN4.

In FIG. 4, the cumulative surface area SR1 is the cumulative surface area of the image formed on the paper P with the black toner TN4 because the image formed on the paper P is a monochrome image.

The ratio of the second consumption amount ST2 to the first consumption amount ST1 is displayed in the second message display area 903. For example, the following message is displayed in the second message display area 903: "The consumption amount of the second toner is 1.03 times the consumption amount of the first toner."

The OK button 904 is to be touched when the user has ascertained content displayed in the container replacement display screen 900. When the OK button 904 is touched, the display section 804 hides the container replacement display screen 90X).

When the remaining amount RTk of a toner TNk detected by the detector 802 is equal to or less than a specific amount RTA, the display section 804 displays the container replacement display screen 900 on the touch panel 141. The specific amount RTA is 2 grams, for example. That is, the remaining amount RTk being equal to or less than the specific amount RTA indicates that the toner container TCk is empty.

The calculating section 803 calculates the coverage PR of the image formed on the paper P, and calculates the first consumption amount ST1 based on the coverage PR. The first consumption amount ST1 is the consumption amount of the toner TN when the toner container TC is a first container TC1. The first container TC is genuine, for example. That is, the first consumption amount ST1 is the consumption amount of a genuine toner TN. A large amount of test data has been accumulated concerning the genuine toner TN. Accordingly, data indicating a relationship between the coverage PR and the first consumption amount ST1 is prestored in the storage 82, for example. The calculating section 803 calculates the first consumption amount ST1 corresponding to the coverage PR based on the data indicating the relationship between the coverage PR and the first consumption amount ST1. The data indicating the relationship between the coverage PR and the first consumption amount ST1 means data indicating multiple values of the coverage PR and values of the first consumption amount ST1 corresponding to the respective values of the coverage PR, for example.

The calculating section 803 calculates the second consumption amount ST2 based on a detection result of the detector 802. For example, a case is described below in which the image forming section 4 performs a print job JB. In the following description, the print job JB forms an image having a specific coverage PR on 100 sheets of the paper P. The calculating section 803 first acquires the remaining amount RTk just before the image is formed on the paper P. The calculating section 803 then acquires the remaining amount RTk just after the print job JB is performed. Next, the calculating section 803 calculates the second consumption amount ST2 per sheet by subtracting the just-after remaining amount RTk from the just-before remaining amount RTk and dividing the resulting difference by the number of sheets (100).

As described above with reference to FIGS. 3 and 4, the display section 804 displays the ratio of the second consumption amount ST2 to the first consumption amount ST1 on the touch panel 141 when the remaining amount RTk of the toner TNk is equal to or less than the specific amount RTA in the embodiment of the present disclosure. Therefore, by setting the specific amount RTA to an extremely small amount (e.g. 2 grams) for example, the ratio of the second consumption amount ST2 to the first consumption amount ST1 can be displayed on the touch panel 141 when the toner TN4 in a second container TC2 has run out. When the toner TN4 housed in the second container TC2 has run out, the second container TC2 is replaced with another toner container TC. Therefore, the user can determine whether to use a first container TC1 or a second container TC2 as the other toner container TC based on the ratio of the second consumption amount ST2 to the first consumption amount ST1. Accordingly, the convenience to the user can further increase.

The detector 802 detects the remaining amount RTk of the toner TN4 housed in the second container TC2, and the calculating section 803 calculates the second consumption amount ST2 based on the detection result of the detector 802. Accordingly, the second consumption amount ST2 can be accurately calculated.

Furthermore, the calculating section 803 calculates the coverage PR of the image formed on the paper P, and calculates the first consumption amount ST1 based on the coverage PR. Accordingly, the first consumption amount ST1 can be easily calculated.

Note that in the embodiment of the present disclosure, the horizontal axis of the graphs displayed in the graph display area 902 in FIG. 4 indicates the coverage PR, but the present disclosure is not limited as such. The horizontal axis of the graphs displayed in the graph display area 902 in FIG. 4 may also be a "number of dots", for example. The number of dots is a cumulative value of how many dots are included in the image formed on the paper P.

Also in the embodiment of the present disclosure, the display section 804 displays the ratio of the second consumption amount ST2 to the first consumption amount ST1 on the touch panel 141 when the remaining amount RTk of the toner TNk is equal to or less than the specific amount RTA, but the present disclosure is not limited as such. For example, the display section 804 may also display the ratio of the second consumption amount ST2 to the first consumption amount ST1 on the touch panel 141 at a timing desired by the user. In this case, the convenience to the user can further increase.

Figure 5:
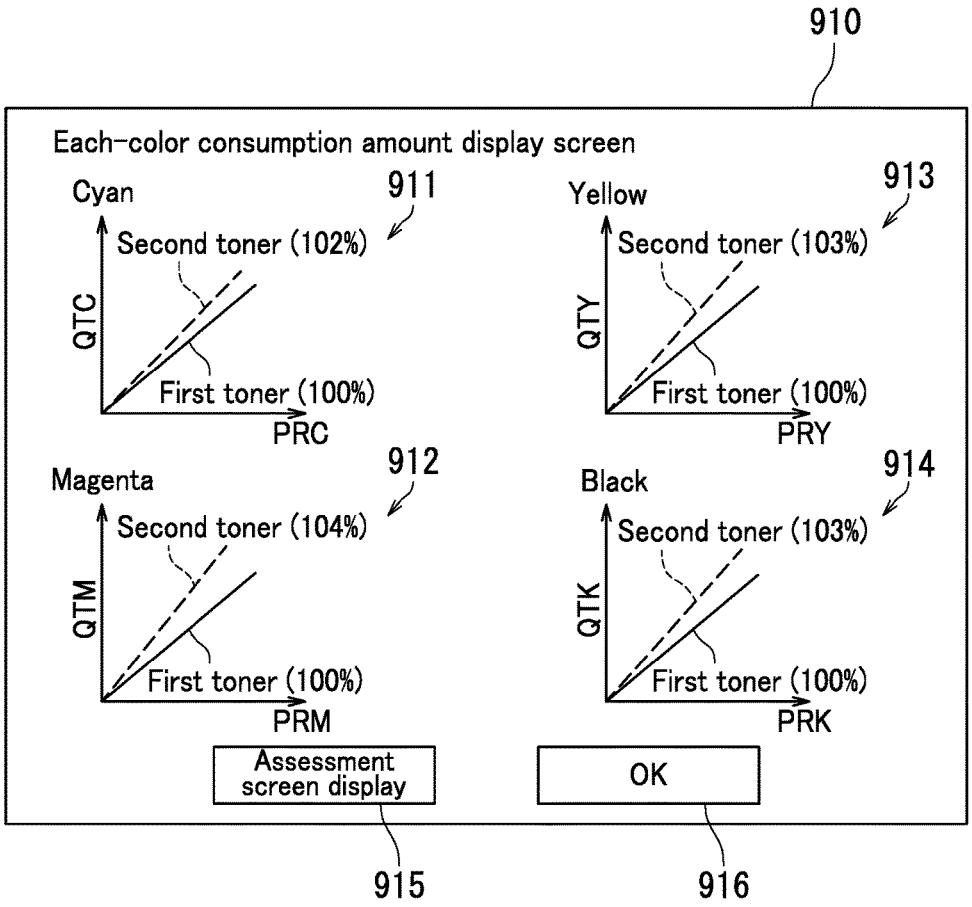
FIG. 5 is a screen diagram illustrating an example of an each-color consumption amount display screen displayed on the touch panel.

Next, the configuration of the controller 8 will be further described with reference to FIGS. 3 to 5. FIG. 5 is a screen diagram illustrating an example of an each-color consumption amount display screen 910 displayed on the touch panel 141. The each-color consumption amount display screen 910 is displayed by the display section 804 when at least one toner container TC among the toner containers TCc to TCk has become empty. A case in which the image formed on the paper P is multi-color is described using FIG. 5.

As illustrated in FIG. 5, a first graph display area 911, a second graph display area 912, a third graph display area 913, a fourth graph display area 914, an assessment screen display button 915, and an OK button 916 are displayed in the each-color consumption amount display screen 910.

A ratio of the second consumption amount ST2 to the first consumption amount ST1 of the cyan toner TN1 is displayed as graphs in the first graph display area 911. That is, a ratio of a consumption amount QTC2 to a consumption amount QTC1 is displayed as graphs in the first graph display area 911. The consumption amount QTC1 is a consumption amount QTC of the cyan toner TN1 when the toner container TCc is a first container TC1. The consumption amount QTC2 is the consumption amount QTC of the cyan toner TN1 when the toner container TCc is a second container TC2. The consumption amount QTC is the consumption amount of cyan toner TN1.

A horizontal axis of the graphs indicates a coverage PRC and a vertical axis of the graphs indicates the consumption amount QTC. The coverage PRC is a ratio of the cumulative surface area SR1 of an image formed with the cyan toner TN1 to the surface area SR2 of the paper P (SR1/SR2). A graph corresponding to the first consumption amount ST1 is indicated by a solid line, and a graph corresponding to the second consumption amount ST2 is indicated by a dotted line. The graph corresponding to the first consumption amount ST1 is labeled with "first toner" and the graph corresponding to the second consumption amount ST2 is labeled with "second toner" in the first graph display area 911. The ratio of the second consumption amount ST2 to the first consumption amount ST1 is 1.02, which is indicated by "first toner (100%)" and "second toner (102%)".

A ratio of the second consumption amount ST2 to the first consumption amount ST1 of the magenta toner TN2 is displayed as graphs in the second graph display area 912. That is, a ratio of a consumption amount QTM2 to a consumption amount QTM1 is displayed as graphs in the second graph display area 912. The consumption amount QTM1 is a consumption amount QTM of the magenta toner TN2 when the toner container TCm is a first container TC1. The consumption amount QTM2 is the consumption amount QTM of the magenta toner TN2 when the toner container TCm is a second container TC2. The consumption amount QTM is the consumption amount of the magenta toner TN2.

A horizontal axis of the graphs indicates a coverage PRM and a vertical axis of the graphs indicates the consumption amount QTM. The coverage PRM is a ratio of the cumulative surface area SR1 of an image formed with the magenta toner TN2 to the surface area SR2 of the paper P (SR1/SR2). A graph corresponding to the first consumption amount ST1 is indicated by a solid line and a graph corresponding to the second consumption amount ST2 is indicated by a dotted line. The graph corresponding to the first consumption amount ST1 is labeled with "first toner" and the graph corresponding to the second consumption amount ST2 is labeled with "second toner" in the second graph display area 912. The ratio of the second consumption amount ST2 to the first consumption amount ST1 is 1.04, which is indicated by "first toner (100%)" and "second toner (104%)".

A ratio of the second consumption amount ST2 to the first consumption amount ST1 of the yellow toner TN3 is displayed as graphs in the third graph display area 913. That is, a ratio of a consumption amount QTY2 to a consumption amount QTY1 is displayed as graphs in the third graph display area 913. The consumption amount QTY1 is a consumption amount QTY of the yellow toner TN3 when the toner container TCy is a first container TC1. The consumption amount QTY2 is the consumption amount QTY of the yellow toner TN3 when the toner container TCy is a second container TC2. The consumption amount QTY is the consumption amount of yellow toner TN3.

A horizontal axis of the graphs indicates a coverage PRY and a vertical axis of the graphs indicates the consumption amount QTY. The coverage PRY is a ratio of the cumulative surface area SR1 of an image formed with the yellow toner TN3 to the surface area SR2 of the paper P (SR1/SR2). A graph corresponding to the first consumption amount ST1 is indicated by a solid line, and a graph corresponding to the second consumption amount ST2 is indicated by a dotted line. The graph corresponding to the first consumption amount ST1 is labeled with "first toner" and the graph corresponding to the second consumption amount ST2 is labeled with "second toner" in the third graph display area 913. The ratio of the second consumption amount ST2 to the first consumption amount ST1 is 1.03, which is indicated by "first toner (100%)" and "second toner (103%)".

A ratio of the second consumption amount ST2 to the first consumption amount ST1 of the black toner TN4 is displayed as graphs in the fourth graph display area 914. That is, a ratio of a consumption amount QTK2 to a consumption amount QTK1 is displayed as graphs in the fourth graph display area 914. The consumption amount QTK1 is the consumption amount QTK of the black toner TN4 when the toner container TCk is a first container TC1. The consumption amount QTK2 is the consumption amount QTK of the black toner TN4 when the toner container TCk is a second container TC2. The consumption amount QTK is the consumption amount of the black toner TN4.

A horizontal axis of the graphs indicates a coverage PRK and a vertical axis of the graphs indicates the consumption amount QTK. The coverage PRK is a ratio of the cumulative surface area SR1 of an image formed with the black toner TN4 to the surface area SR2 of the paper P (SR1/SR2). A graph corresponding to the first consumption amount ST1 is indicated by a solid line, and a graph corresponding to the second consumption amount ST2 is indicated by a dotted line. The graph corresponding to the first consumption amount ST1 is labeled with "first toner" and the graph corresponding to the second consumption amount ST2 is labeled with "second toner" in the fourth graph display area 914. The ratio of the second consumption amount ST2 to the first consumption amount ST1 is 1.03, which is indicated by "first toner (100%)" and "second toner (103%)".

Figure 6:
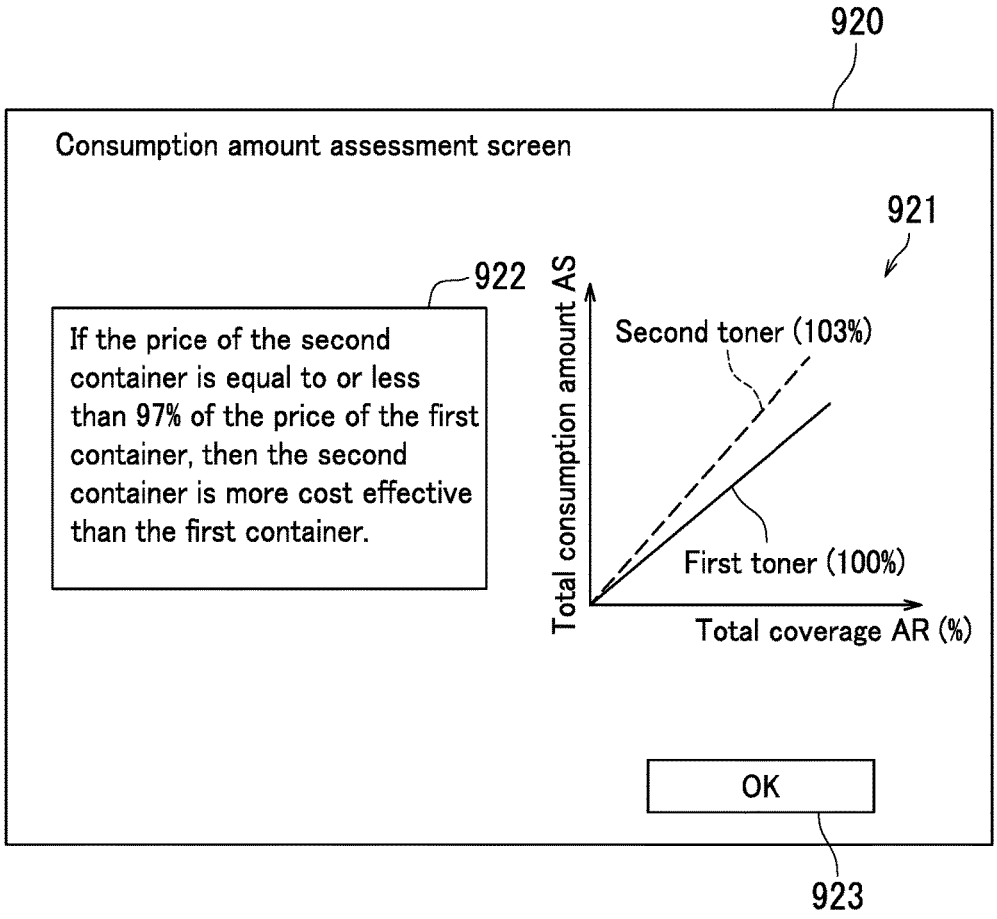
FIG. 6 is a screen diagram illustrating an example of a consumption amount assessment display screen displayed on the touch panel.

The assessment screen display button 915 is a button to be touched by the user to display a consumption amount assessment screen 920 illustrated in FIG. 6. When the assessment screen display button 915 is touched, the display section 804 hides the each-color consumption amount display screen 910 and displays the consumption amount assessment screen 920.

The OK button 916 is touched when the user has ascertained the content displayed in the each-color consumption amount display screen 910. When the OK button 916 is touched, the display section 804 hides the each-color consumption amount display screen 910.

The determining section 801 then determines whether each of the toner containers TCc to TCk is a first container TC1 or a second container TC2.

The display section 804 displays the ratio of the second consumption amount ST2 to the first consumption amount ST1 for each of the toner containers TCc to TCk on the touch panel 141 according to determination results of the determining section 801. Specifically, the display section 804 displays the each-color consumption amount display screen 910 on the touch panel 141 when at least one toner container TC among the toner containers TCc to TCk is determined to be a second container TC2 and at least one second container TC2 has become empty.

As described above with reference to FIGS. 3 to 5, the ratio of the second consumption amount ST2 to the first consumption amount ST1 for each of the toner containers TCc to TCk is displayed on the touch panel 141 in the embodiment of the present disclosure. Therefore, the user can ascertain the ratio of the second consumption amount ST2 to the first consumption amount ST1 for each of the toner containers TCc to TCk. Accordingly, the convenience for the user can further increase.

Next, the configuration of the controller 8 will be further described with reference to FIGS. 3 to 6. FIG. 6 is a screen diagram illustrating an example of the consumption amount assessment screen 920 displayed on the touch panel 141. The consumption amount assessment screen 920 is displayed when the assessment screen display button 915 in the each-color consumption amount display screen 910 illustrated in FIG. 5 is touched.

As illustrated in FIG. 6, a graph display area 921, a message display area 922, and an OK button 923 are displayed in the consumption amount assessment screen 920.

A ratio of a second total consumption amount AS2 to a first total consumption amount AS1 is displayed as graphs in the graph display area 921. The first total consumption amount AS1 is a sum of the consumption amount QTC1, the consumption amount QTM1, the consumption amount QTY1, and the consumption amount QTK1. The second total consumption amount AS2 is a sum of the consumption amount QTC2, the consumption amount QTM2, the consumption amount QTY2, and the consumption amount QTK2.

A horizontal axis of the graphs indicates a total coverage AR, and a vertical axis of the graphs indicates a total consumption amount AS. The total coverage AR is a sum of the coverage PRC, the coverage PRM, the coverage PRY, and the coverage PRK. A graph corresponding to the first total consumption amount AS1 is indicated by a solid line, and a graph corresponding to the second total consumption amount AS2 is indicated by a dotted line. The graph corresponding to the first total consumption amount AS1 is labeled with "first toner", and the graph corresponding to the second total consumption amount AS2 is labeled with "second toner" in the graph display area 921. The ratio of the second total consumption amount AS2 to the first total consumption amount AS1 is 1.03, which is indicated by "first toner (100%)" and "second toner (103%)".

An assessment result of costs of a first container TC1 and a second container TC2 are displayed in the message display area 922. For example, the following message is displayed in the message display area 922: "If the price of the second container is equal to or less than 97% of the price of the first container, then the second container is more cost effective than the first container."

The calculating section 803 calculates the first total consumption amount AS1 and the second total consumption amount AS2. The first total consumption amount AS1 is a total value of first consumption amounts ST1 when all toner containers TCc to TCk are first containers TC1. The second total consumption amount AS2 is a total value of second consumption amounts ST2 when all toner containers TCc to TCk are second containers TC2.

The display section 804 displays the ratio of the second total consumption amount AS2 to the first total consumption amount AS1 on the touch panel 141.

The calculating section 803 calculates a cost CS2 per unit amount of a second toner TNB such that a cost of the second total consumption amount AS2 of the second toner TNB matches a cost of the first total consumption amount AS1 of a first toner TNA. The first toner TNA is the toner TN housed in a first container TC1. The second toner TNB is the toner TN housed in a second container TC2. That is, the calculating section 803 calculates the cost CS2 per unit amount of the second toner TNB fulfilling the following formula (1).

$$\text{Cost } CS2 \times \text{second total consumption amount } AS2 = \text{cost } CS1 \times \text{first total consumption amount } AS1 \quad (1)$$

The cost CS1 is a cost per unit amount of the first toner TNA. The cost CS2 is a cost per unit amount of the second toner TNB. The unit amount is 1 gram, for example. In FIG. 6, the cost CS2 fulfilling the formula (1) is approximately 97(≈100/103×100)% of the cost CS1 because the ratio of the second total consumption amount AS2 to the first total consumption amount AS1 is 1.03.

The display section 804 displays a ratio of the cost CS2 to the cost CS1 on the touch panel 141. In FIG. 6, the cost CS2 is displayed as approximately 97% of the cost CS1 in the message display area 922.

As described above with reference to FIGS. 3 to 6, the calculating section 803 calculates the first total consumption amount AS1 and the second total consumption amount AS2, and the display section 804 displays the ratio of the second total consumption amount AS2 to the first total consumption amount AS1 on the touch panel 141 in the embodiment of the present disclosure. Therefore, the user can ascertain the ratio of the second total consumption amount AS2 to the first total consumption amount AS1. Accordingly, the convenience for the user can further increase.

The calculating section 803 also calculates the cost CS2 fulfilling the formula (1). The display section 804 displays the ratio of the cost CS2 to the cost CS1 on the touch panel 141. Therefore, the user can ascertain the ratio of the cost CS2 to the cost CS1. Accordingly, the convenience for the user can further increase.

Specifically, the user can determine that use of a first container TC1 is more cost effective than use of a second container TC2 when the ratio of a unit price of the second container TC2 to a unit price of the first container TC1 is greater than the ratio of the cost CS2 to the cost CS1.

Note that in the embodiment of the present disclosure, the display section 804 displays the ratio of the second total consumption amount AS2 to the first total consumption amount AS1, but the present disclosure is not limited as such. The display section 804 may also display a ratio of the first total consumption amount AS1 to the second total consumption amount AS2.

Also in the embodiment of the present disclosure, the calculating section 803 calculates the cost CS2 fulfilling the formula (1), but the present disclosure is not limited as such. For example, the calculating section 803 may also calculate the cost CS2 per unit amount of the second toner TNB such that the cost of the second consumption amount ST2 of the second toner TNB matches the cost CS1 of the first consumption amount ST1 of the first toner TNA. That is, the calculating section 803 may calculate the cost CS2 fulfilling the following formula (2).

$$\text{Cost } CS2 \times \text{second consumption amount } ST2 = \text{cost } CS1 \times \text{first consumption amount } ST1 \quad (2)$$

Also in the embodiment of the present disclosure, the first total consumption amount AS1 is a sum of the consumption amount QTC1, the consumption amount QTM1, the consumption amount QTY1, and the consumption amount QTK1, but the present disclosure is not limited as such. For example, the first total consumption amount AS1 may also be a weighted sum of the consumption amount QTC1, the consumption amount QTM1, the consumption amount QTY1, and the consumption amount QTK1, or may be a weighted average thereof. In this case, a more accurate value can be displayed by accurately setting a weight. For example, the weight may be the cost per unit amount of the toner TN.

Similarly, the second total consumption amount AS2 is a sum of the consumption amount QTC2, the consumption amount QTM2, the consumption amount QTY2, and the consumption amount QTK2. However, the second total consumption amount AS2 may also be a weighted sum of the consumption amount QTC2, the consumption amount QTM2, the consumption amount QTY2, and the consumption amount QTK2, for example, or may be a weighted average thereof.

Figure 7:
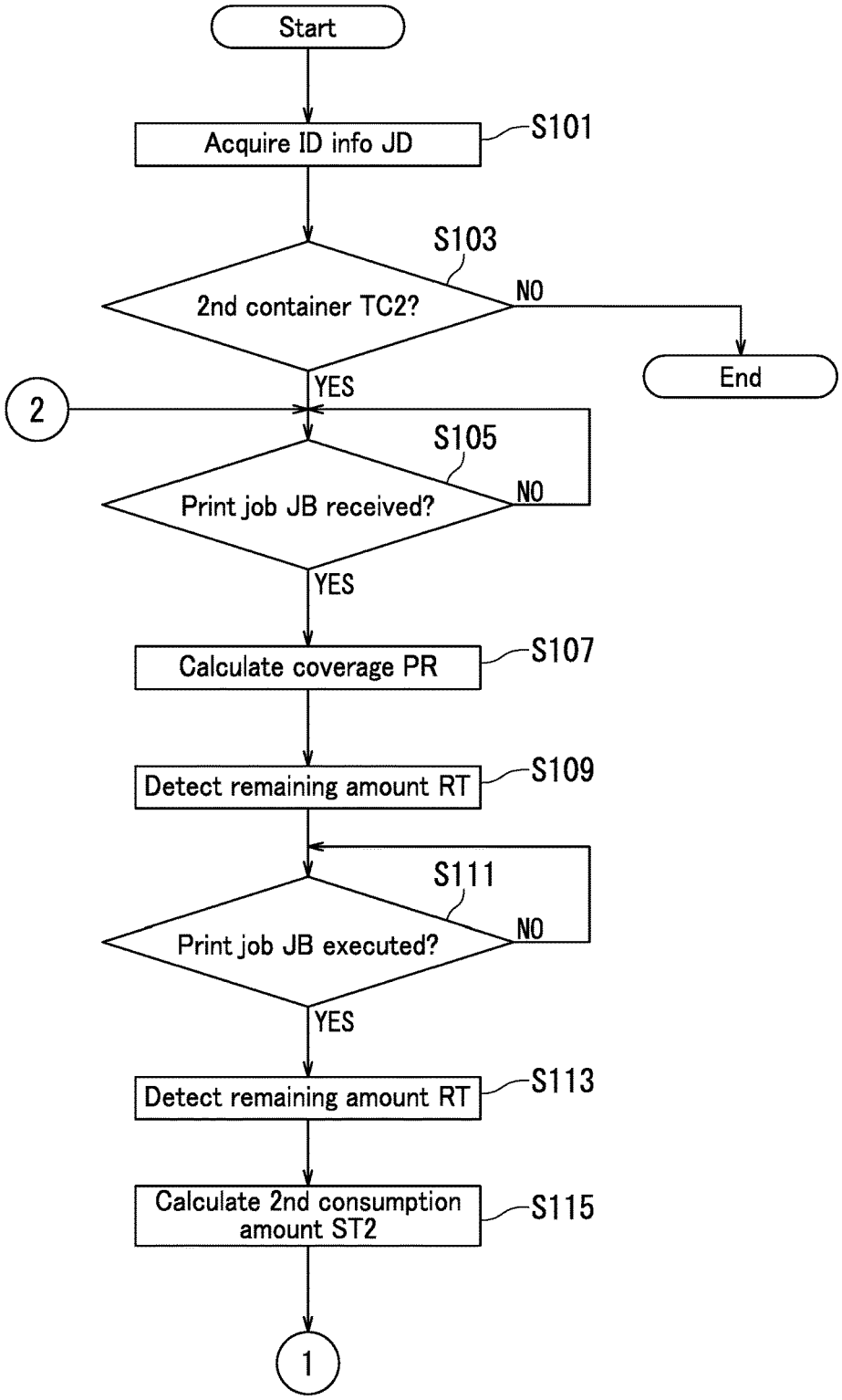
FIG. 7 is a flowchart illustrating an example of a process performed by the controller.
Figure 8:
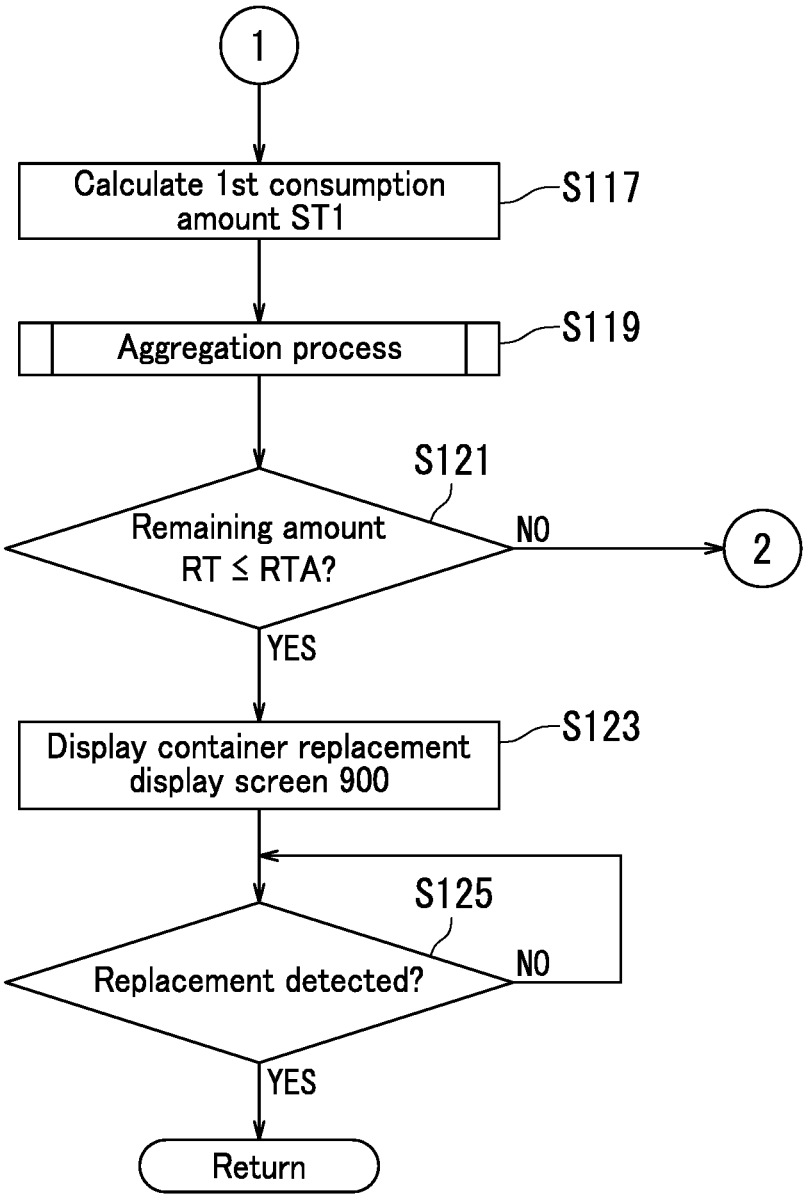
FIG. 8 is a flowchart further illustrating the example of the process performed by the controller.

Next, a process to be performed by the controller 8 will be described with reference to FIGS. 3 to 9. FIGS. 7 and 8 are flowcharts illustrating an example of the process performed by the controller 8. In FIGS. 7 and 8, a case is described in which the image formed on the paper P is monochrome.

As illustrated in FIG. 7, the determining section 801 acquires the identification information JD of the toner container TC mounted to the toner supply section 13 through the reader 7 in Step S101.

Next, in Step S103, the determining section 801 determines whether or not the toner container TC mounted to the toner supply section 13 is a second container TC2.

When the determining section 801 determines that the toner container TC mounted to the toner supply section 13 is not a second container TC2 (NO in Step S103), the process is ended. When the determining section 801 determines that the toner container TC mounted to the toner supply section 13 is a second container TC2 (YES in Step S103), the process advances to Step S105.

Then, in Step S105, the controller 8 determines whether or not a print job JB has been received. The print job JB is a job for forming the image on the paper P.

When the controller 8 determines that the print job JB has not been received (NO in Step S105), the process enters a standby state. When the controller 8 determines that the print job JB has been received (YES in Step S105), the process advances to Step S107.

Then, in Step S107, the calculating section 803 calculates the coverage PR of the image formed on the paper P.

Next, in Step S109, the detector 802 detects the remaining amount RT of the toner TN housed in the toner container TC through the remaining amount sensor S.

Next, in Step S111, the controller 8 determines whether or not the print job JB has been executed.

When the controller 8 determines that the print job JB has not been executed (NO in Step S111), the process enters a standby state. When the controller 8 determines that the print job JB has been executed (YES in Step S111), the process advances to Step S113.

Then, in Step S113, the detector 802 detects the remaining amount RT of the toner TN housed in the toner container TC through the remaining amount sensor S.

Next, in Step S115, the calculating section 803 calculates the second consumption amount ST2. Specifically, the calculating section 803 calculates a difference obtained by subtracting the remaining amount RT detected in Step S113 from the remaining amount RT detected in Step S109 as the second consumption amount ST2.

Next, as illustrated in FIG. 8, the calculating section 803 calculates the first consumption amount ST1 in Step S117.

Next, in Step S119, the controller 8 executes an "aggregation process". The aggregation process is a process by which the total coverage AR, the first total consumption amount AS1, and the second total consumption amount AS2 are calculated. The aggregation process will be described later in detail with reference to FIG. 9.

Next, in Step S121, the controller 8 determines whether or not the remaining amount RT is equal to or less than the specific amount RTA. The remaining amount RT being equal to or less than the specific amount RTA means that the second container TC2 is empty.

When the controller 8 determines that the remaining amount RT is more than the specific amount RTA (NO in Step S121), the process returns to Step S105 in FIG. 7. When the controller 8 determines that the remaining amount RT is equal to or less than the specific amount RTA (YES in Step S121), the process advances to Step S123.

Then, in Step S123, the display section 804 displays the container replacement display screen 900 on the touch panel 141.

Next, in Step S125, the controller 8 determines whether or not the second container TC2 has been replaced.

When the controller 8 determines that the second container TC2 has not been replaced (NO in Step S125), the process enters a standby state. When the controller 8 determines that the second container TC2 has been replaced (YES in Step S125), the process returns to Step S101 in FIG. 7.

Figure 9:
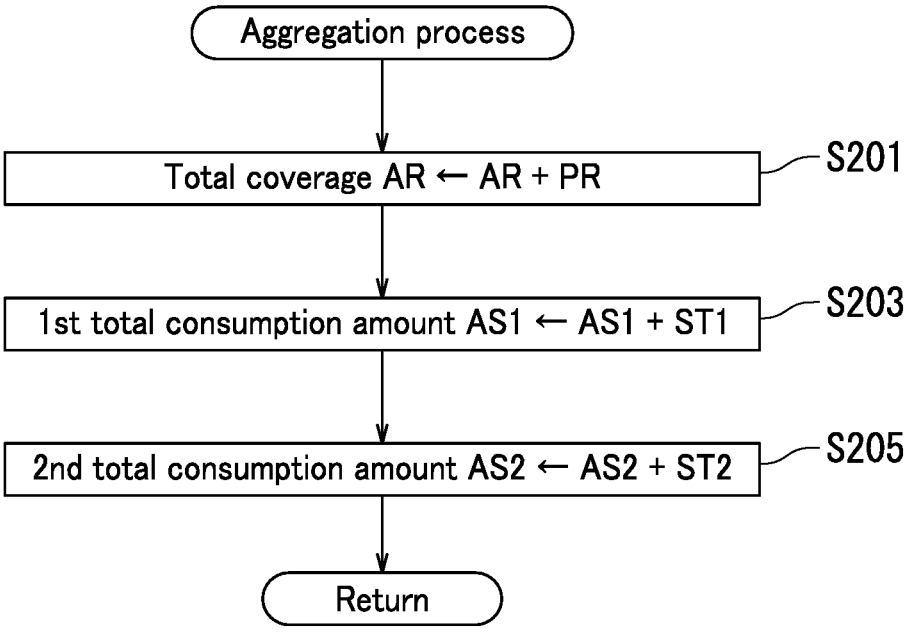
FIG. 9 is a flowchart illustrating an example of an aggregation process performed by the controller.

FIG. 9 is a flowchart illustrating an example of the aggregation process performed by the controller 8.

As illustrated in FIG. 9, the calculating section 803 updates the total coverage AR so that the total coverage AR increases by the coverage PR in Step S201.

Next, in Step S203, the calculating section 803 updates the first total consumption amount AS1 so that the first total consumption amount AS1 increases by the first consumption amount ST1.

Next, in Step S205, the calculating section 803 updates the second total consumption amount AS2 so that the second total consumption amount AS2 increases by the second consumption amount ST2. The process then returns to Step S121 illustrated in FIG. 8.

As described above with reference to FIGS. 3 to 9, the display section 804 displays the container replacement display screen 900 on the touch panel 141 in the embodiment of the present disclosure, but the present disclosure is not limited as such. The display section 804 may also display the each-color consumption amount display screen 910.

The embodiment of the present disclosure has been described above with reference to the drawings. However, the present disclosure is not limited to the above-mentioned embodiment and may be implemented in various manners within a scope not departing from the gist thereof (as below in (1) to (3), for example). The drawings are schematic illustrations that emphasize elements of configuration in order to facilitate understanding thereof. Properties of the elements of configuration illustrated in the drawings, such as thickness, length, and number thereof, may differ from actual properties thereof in order to facilitate preparation of the drawings. Properties of the elements of configuration illustrated in the above-mentioned embodiment such as shape and size are one example, not particularly limited, and may be variously altered within a scope not substantially departing from the configuration of the present disclosure.

(1) As described with reference to FIGS. 1 and 2, the consumable item is a toner and the replacement item is a toner container TC in the embodiment of the present disclosure, but the present disclosure is not limited as such. The consumable item need only be consumed to form the image on the paper P. For example, the consumable item may be ink, and the replacement item may be an ink cartridge. In this case, the image forming apparatus is an inkjet recording apparatus.

(2) As described with reference to FIGS. 1 and 2, the image forming apparatus 100 is a color multifunction peripheral in the embodiment of the present disclosure, but the present disclosure is not limited as such. The image forming apparatus 100 need only form the image on the paper P. For example, the image forming apparatus 100 may be a monochrome multifunction peripheral or a color printer.

(3) As described with reference to FIGS. 1 to 3, the first container TC1 is genuine and the second container TC2 is not genuine in the embodiment of the present disclosure, but the present disclosure is not limited as such. The first container TC need only house a "first quality" toner, and the second container TC2 need only house a "second quality" toner. The first quality toner differs in quality compared to the second quality toner. Specifically, the first quality toner is of higher quality than the second quality toner.

What is claimed is:

1. An image forming apparatus comprising:

a mounting section to which a replacement component housing a consumable item is to be mounted;

an image forming section configured to form an image on a recording medium by consuming the consumable item;

a display;

a determining section configured to determine whether the replacement component mounted to the mounting section is a first replacement component or a second replacement component which differs from the first replacement component;

a calculating section configured to calculate a consumption amount of the consumable item consumed for the image forming section to form the image on the recording medium when the determining section determines that the replacement component is the second replacement component; and a display section configured to display a ratio of a second consumption amount to a first consumption amount or a ratio of the first consumption amount to the second consumption amount on the display, wherein the first consumption amount is a consumption amount of the consumable item when the replacement component is the first replacement component, and the second consumption amount is a consumption amount of the consumable item when the replacement component is the second replacement component.

2. The image forming apparatus according to claim 1, further comprising a detector configured to detect a remaining amount of the consumable item housed in the second replacement component, wherein the calculating section calculates the second consumption amount based on a detection result of the detector.

3. The image forming apparatus according to claim 2, wherein the display section displays the ratio of the second consumption amount to the first consumption amount or the ratio of the first consumption amount to the second consumption amount on the display when the remaining amount of the consumable item detected by the detector is equal to or less than a specific amount.

4. The image forming apparatus according to claim 1, wherein the calculating section calculates a coverage of the image and calculates the first consumption amount based on the coverage.

5. The image forming apparatus according to claim 1, wherein a plurality of replacement components respectively housing consumable items of a plurality of colors is mounted to the mounting section, the image forming section forms a color image on the recording medium by consuming the consumable items of the plurality of colors, the determining section determines whether each of the plurality of replacement components is the first replacement component or the second replacement component, and the display section displays the ratio of the second consumption amount to the first consumption amount or the ratio of the first consumption amount to the second consumption amount on the display for each of the plurality of replacement components according to a determination result of the determining section.

6. The image forming apparatus according to claim 5, wherein the calculating section calculates a first total value and a second total value when the image forming section forms the color image on the recording medium, the display section displays a ratio of the second total value to the first total value or a ratio of the first total value to the second total value on the display, the first total value is a total value of the consumption amount of the consumable items of the plurality of replacement components when all of the plurality of replacement components are the first replacement components, and the second total value is a total value of the consumption amount of the consumable items of the plurality of replacement components when all of the plurality of replacement components are the second replacement components.

7. The image forming apparatus according to claim 5, wherein the calculating section calculates a first total value and a second total value when the image forming section forms the color image on the recording medium, the display section displays a ratio of the second total value to the first total value or a ratio of the first total value to the second total value on the display, the first total value is a weighted sum of the consumption amount of the consumable items of the plurality of replacement components when all of the plurality of replacement components are the first replacement components, and the second total value is a weighted sum of the consumption amount of the consumable items of the plurality of replacement components when all of the plurality of replacement components are the second replacement components.

8. The image forming apparatus according to claim 7, wherein weight of the weighted sum is a cost per unit amount of the consumable item.

9. The image forming apparatus according to claim 1, wherein the consumable item is a first consumable item housed in the first replacement component and a second consumable item housed in the second replacement component, and when the second consumption amount is greater than the first consumption amount:

the calculating section calculates a cost per unit amount of the second consumable item such that a cost of the second consumption amount of the second consumable item matches a cost of the first consumption amount of the first consumable item, and the display section displays a ratio of the cost per unit amount of the second consumable item to a cost per unit amount of the first consumable item on the display.

* * * * *